United States Patent [19]

Stahlecker

[11] 3,962,855

[45] June 15, 1976

[54] START-SPINNING APPARATUS WHICH TRAVELS ALONG AN OPEN-END SPINNING MACHINE

[75] Inventor: Fritz Stahlecker, Bad Uberkingen, Germany

[73] Assignees: Fritz Stahlecker; Hans Stahlecker, Germany

[22] Filed: Dec. 9, 1974

[21] Appl. No.: 531,162

[30] Foreign Application Priority Data

Dec. 12, 1973 Germany ..... 2361787

[52] U.S. Cl. ..... 57/34 R; 57/58.89

[51] Int. Cl.[2] ..... D01H 15/00

[58] Field of Search ..... 57/34 R, 56, 58.89–58.95

[56] References Cited

UNITED STATES PATENTS 3,791,126 2/1974 Kose et al. ..... 57/58.89 X 3,810,352 5/1974 Miyazaki et al. ..... 57/56 X

*Primary Examiner*—Donald E. Watkins

*Attorney, Agent, or Firm*—Craig & Antonelli

[57] ABSTRACT

A start-spinning apparatus which travels along an open-end spinning machine has means which lift a winding cone of an open-end spinning unit away from its drive means, which pick up an end of the thread from the winding cone and which return said end to a spinning rotor of the open-end spinning unit again for start spinning, and which finally withdraw the thread therefrom again. In order to produce precise operating conditions, the return of the end of the thread to the spinning rotor and drawing off of the thread again are controlled by a separate pair of trapping rollers after the end of the thread, which has been trimmed to a certain length, has been transferred to a yarn removal channel leading to the spinning rotor by a transfer trapper.

26 Claims, 17 Drawing Figures

14
24
28
26
27
21
22
29
23
5a
6
19
20
25
12
11
4a
16
17
15
18
10
2
1
13
3
4
5
6
7
8
9

Fig.6
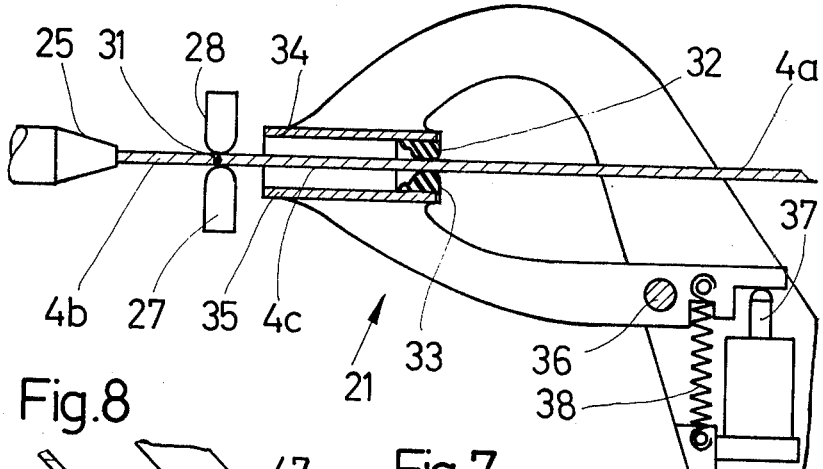
Fig.8
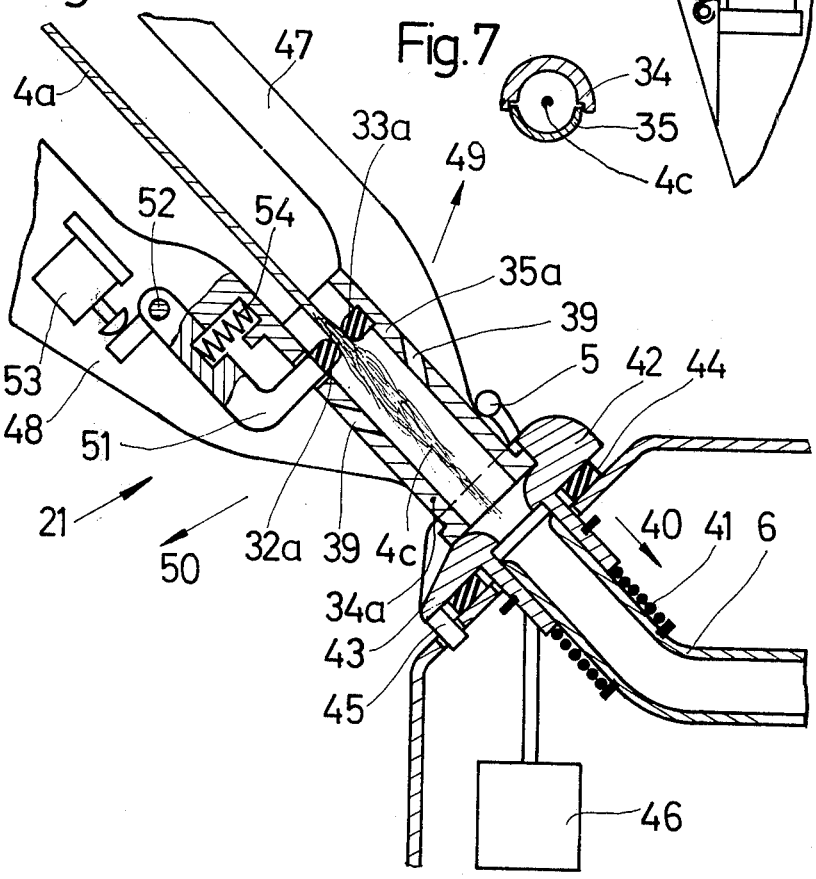
Fig.7

START-SPINNING APPARATUS WHICH TRAVELS ALONG AN OPEN-END SPINNING MACHINE

The present invention relates to a start-spinning apparatus, which travels along an open-end spinning machine, having means for lifting away a winding cone, a suction nozzle for removing an end of the thread from the winding cone, trimming means for trimming the end of the thread and means for unwinding and then rewinding the thread, with movable transfer means for the end of the thread being provided between the trimming means and a yarn removal channel of the spinning unit leading to a spinning rotor.

In a known start-spinning apparatus which travels along a spinning machine (German Pat. No. 2,012,108), there are means for lifting away the winding cone, thereby interrupting the normal drive of this winding cone. The winding cone is simultaneously pressed against a winding roller of the start-spinning unit, through which the return of the thread to the spinning rotor and withdrawal thereof again, which is necessary for start spinning, is controlled. In the known design, the end of the thread is picked up by a suction nozzle and supplied to trimming means through a slotted suction channel. The trimming means offer the end of the thread, which has been cut to a given length, to a yarn removal channel of the spinning unit with thread gripping means, which are arranged on a support arm which can be pivoted about a perpendicular axis, whereby the end of the thread is then sucked into the spinning rotor through the yarn removal channel.

The advantage of the above described design over other known designs, in which a separate start-spinning unit is provided for each spinning point, is that only a limited amount of those means which require a relatively high degree of mechanical and control sophistication must be provided and that said means can be employed for a plurality of spinning points, one after the other. However the conditions for the start-spinning operation itself are rather inaccurate, so that defects can be expected relatively frequently in connection with start spinning. In particular, with the known apparatus it is not possible to stipulate the start-spinning moment and start-spinning speed, i.e. the reversal between return of the broken end of the thread and withdrawal of the thread again, precisely enough. Since the end of the thread is returned and the thread is withdrawn again by friction drive between the winding cone and the winding roller of the start-spinning unit, there is no way to avoid slipping here, which leads to inaccuracies. During reversal of the sense of rotation, especially, the mass of the winding cone is especially noticeable with respect to the slipping that occurs, whereby in the case of a winding cone that is almost full there is more slipping than in the case of a winding cone that is almost empty. Another unfavourable factor is the fact that, after being trimmed to length by trimming means, the end of the thread is only held pneumatically by the thread gripping means, so that there is a risk that it shifts longitudinally while being returned to the yarn removal channel of the spinning point, which would lead to a change in the start-spinning conditions again. Another unfavourable factor is the fact that the suction means, with which the broken end is picked up from the winding cone, have a longitudinal slot, as an especially high suction is necessary here, which results in an unreasonably high power requirement of the machine.

It is the object of the present invention to create a start-spinning apparatus which travels along an open-end spinning machine, in which the start-spinning conditions of each start-spinning operation remain mutually uniform and highly accurate. According to the present invention, this object is solved in that the suction nozzle, which can be moved to the area of the winding cone, places the thread picked up thereby in the effective area of a pair of trapping rollers, serving to return the thread to the spinning rotor and to draw it off again, and of the trimming means, and in that a transfer trapper, which traps the thread in the area of the trimming means, serves as the transfer means.

The apparatus according to the present invention permits the thread to be supplied in either direction without a time lag and in the precise length. Differences in the size of the winding cone cannot have a disadvantageous effect on the start-spinning operation. The thread held in the transfer trapping means is transferred in a precisely defined position, thereby eliminating the possibility of longitudinal shifting through the trapped condition. In addition, the power required, especially for generating the underpressure, can be kept low.

In an advantageous development of the invention, the trimming means are combined with separating means which free the end of the thread of its spinning twist. By trapping the end of the thread, it is possible to separate the end of the thread without causing a change in the location of the end of thread. Separating the end of the thread prior to its introduction into the spinning rotor results in a further improvement of the start-spinning operation; in particular, it is possible to avoid overly thick or overly thin points in the area of the start-spinning point.

In an advantageous development of the invention, a tension feeler, over which the thread is placed, is disposed between the pair of trapping rollers and the yarn removal channel. It is now possible to control the speed and the reversal of the sense of rotation of the pair of trapping rollers, which is decisive for supplying and withdrawing the thread again as a factor of the tension. This results in even more uniform joining at the individual spinning points than if only the returned thread length were measured.

In a further development of the invention, in the closed state, the transfer trapping means have an extension which extends toward the end of the thread and which at least partially surrounds the end of the thread. This permits the end of the thread to be transferred to the spinning point to be given, or retain, the direction which is most favourable for performing the transfer operation. This especially advantageous development is suited for any transfer trapping means or similar means with which the thread to be transferred is to be inserted in a channel or similar aperture. In a further development, the extension has openings through which supply air can flow in. This further aids alignment of the end of the thread. In addition, it is also practical to dispose a pressure member which yields in the direction of the yarn removal channel between the extension and the yarn removal channel. This further development permits the unavoidable length tolerances between the transfer trapping means of the mobile apparatus and the yarn removal channel of the stationary spinning point to be compensated for. The yielding pressure member can be arranged either on the transfer trapping means or on the yarn removal channel.

In an advantageous development of the invention, the extension comprises primarily two dish-like members which can be separated one from the other. In this connection, it is practical for the transfer trapping means and the extension thereof to open and close at right angles to their direction of swivel. In this manner, it is possible to open and close the transfer trapping means in a direction which cannot affect the travel of the thread.

In a further advantageous development, the transfer trapping means are equipped with at least one compressed air nozzle, which generates a flow of air directed onto the free end of the thread located behind the trapping point, generally in the longitudinal direction of the end of the thread and the yarn removal channel. This permits a thread end which has already been separated to be additionally aligned in the transfer trapping means and in the yarn removal channel, whereby an end of the thread which has only been partially separated can be further opened and separated.

The above discussed and other objects, features and advantages of the present invention will become more apparent from the following description thereof, when taken in connection with the accompanying drawings, in which:

FIGS. 6 to 17 show developments of the mobile start-spinning unit in the area of a transfer trapper, with which the end of the thread is offered to a yarn removal channel of the spinning point.

Figures 1, 2:
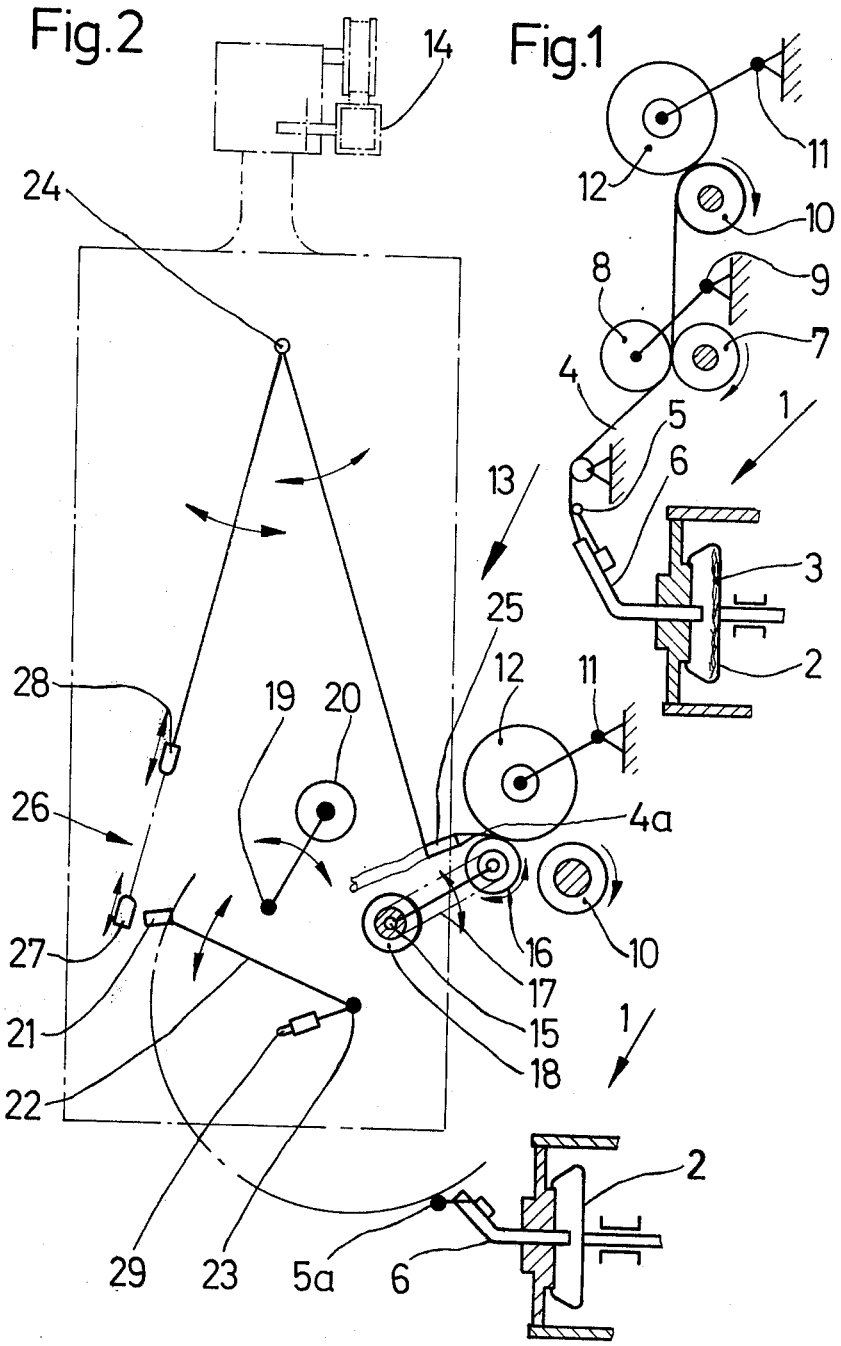
FIG. 1 shows a schematic representation of an open-end spinning unit in the area of the thread draw-off and winding means in the operating condition.
FIGS. 2 to 5 show the spinning unit with an apparatus for start-spinning according to the present invention, which has travelled thereto, in the individual stages of the start-spinning operation.
Figure 3:
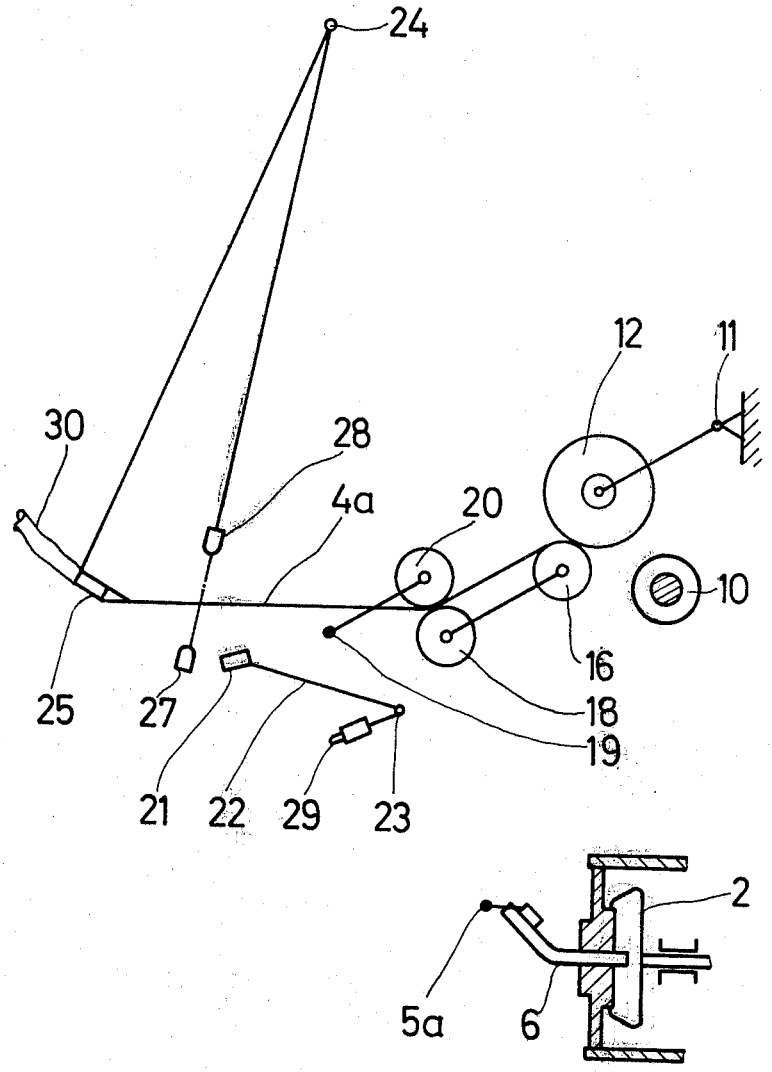

Referring now to the drawings, wherein like reference numerals designate like parts throughout the several views, FIG. 1 shows an open-end spinning machine, which is generally equipped with plurality of spinning units 1, disposed longitudinally one next to the other along the machine, whereby parts which are not of significance for the invention have been left away.

The ring 3 of separated, supplied fibres which is deposited in a spinning rotor 2 is spun into a thread 4 which, monitored by a thread stop-motion, is withdrawn from the yarn removal channel 6 by means of two draw-off rollers 7 and 8. While draw-off roller 7 is driven in the direction of the arrow, roller 8 is designed as a freely rotatable pressure roller, which can be pivoted about axle 9, which is fixedly arranged on the machine. Thread 4 is wound onto a winding cone 12, which can be pivoted about a stationary axle 11, by means of a driven winding roller 10.

If thread 4 breaks for any reason, thread stop-motion 5 changes from its original position to position 5*a* (cf. FIG. 2). The broken end of thread 4 is then located somewhere on the periphery of cone 12, which continues to be driven by winding roller 10. The broken end of the thread must be searched for and returned through yarn removal channel 6 to spinning rotor 2 for start spinning. In the present invention, this is performed by means of a start-spinning unit 13, whose contours are indicated as a dash-dotted line in FIG. 2. Start-spinning unit 13 can travel longitudinally along the open-end spinning machine on a stationary rail 14 and can stop at the respective spinning unit 1 requiring maintenance in order to start-spin the broken end of the thread again. Searching for, returning and drawing off the end of the thread again through the operating elements of start-spinning unit 13 is illustrated and explained in FIGS. 2 to 5, whereby for reasons of clarity all design details, in particular the drive and control means, which do not form a part of the present invention have been left away.

Unillustrated control means cause start-spinning unit 13 to travel to a spinning unit 1 requiring maintenance. By means of a roller 16, which can be driven in either sense of rotation and which can be pivoted about axle 15, of start-spinning unit 13, winding cone 12 is first lifted away from winding roller 10 and stopped.

Connected in a driving relationship with roller 16, e.g. by means of a toothed belt 17, is a roller 18 which, together with a pressure roller 20 which can be pivoted about an axle 19, forms a pair of trapping rollers 18, 20. Start-spinning unit 13 further comprises a transfer trapper 21, which can be pivoted about axle 23 by means of a swivel arm 22 and which can introduce the thread to be start spun into yarn removal channel 6. Start-spinning unit 13 further comprises a suction nozzle 25, which can be pivoted about an axle 24, for searching for the broken end of the thread and a trimming unit 26, comprising two trimming elements 27 and 28, which can also be pivoted about axle 24. And finally, there is also a tension feeler 29 for controlling the unillustrated drive means.

The apparatus, which has travelled to the respective spinning point, operates as follows (cf. FIGS. 2 to 5):

After winding cone 12 is lifted away from its winding roller 10 by means of roller 16, suction nozzle 25 swivels about axle 24 into the immediate vicinity of winding cone 12, and searches for the broken end 4a of the thread by means of a suction flow (FIG. 2). As an aid to searching and "finding" the end 4a of the thread by suction nozzle 25, cone 12 is driven briefly in the unwinding direction by roller 16. As shown in FIG. 2, the open pair of trapping rollers 18, 20 as well as transfer trapper 21 and trimming unit 26 remain inoperative for the time being. Suction nozzle 25, equipped with a flexible suction line, now swivels into the position illustrated in FIG. 3 together with the end 4a of the thread it had been searching for. During this swivel sequence, roller 16 drives cone 12 in the reverse sense of rotation. Pressure roller 20 now swivels about axle 19 and comes into a contacting relationship with driven roller 18, causing trapping roller pair 18, 20 to trap thread 4a. Swivel arm 22 of transfer trapper 21 now swivels about axle 23 into the position shown in FIG. 4, thereby providing additional clamping of thread 4a to be start-spun. Immediately thereafter, trimming unit 26 goes into operation and trims section 4b of the thread at a predetermined point with its trimming elements 27 and 28, with section 4b of the thread being sucked in by suction nozzle 25 and removed. It is practical for trimming elements 27, 28 to be designed in such a manner that section 4c of the thread is relieved of at least a portion of its spinning twist between transfer trapper 21 and the trimming point. This better prepares thread 4a to be start-spun for the start-spinning operation.

Figure 5:
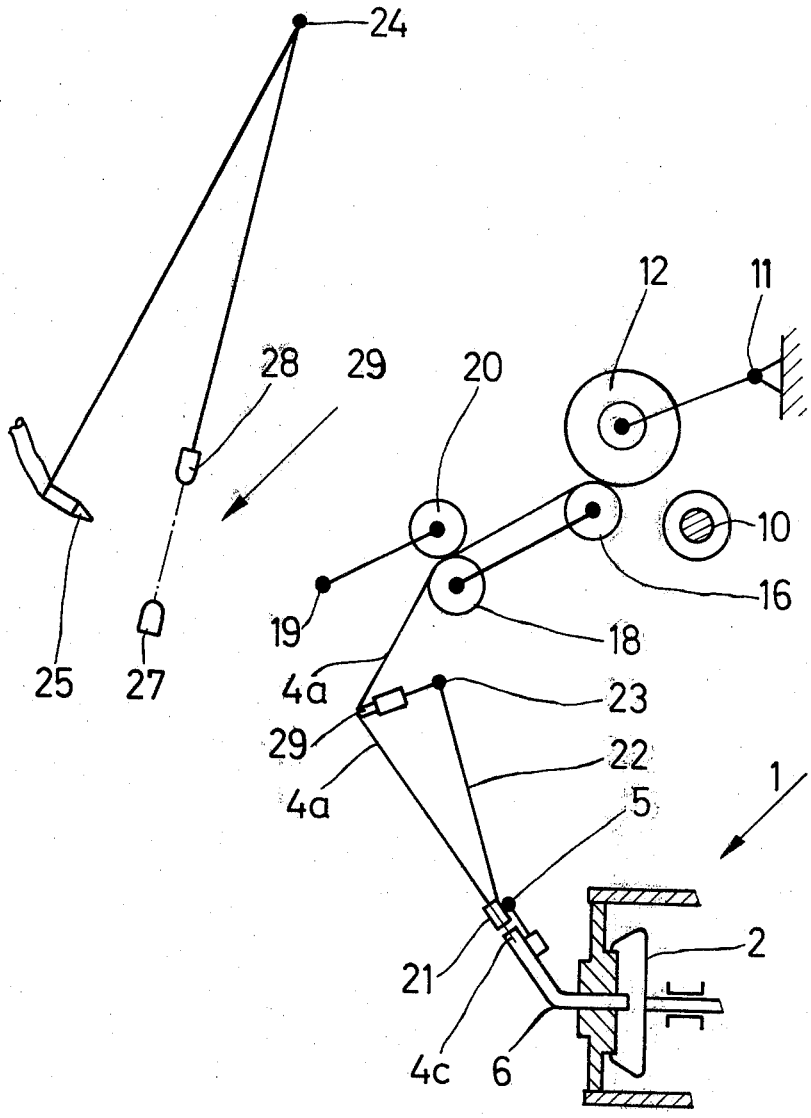

FIG. 5 shows the last phase of the transfer of the thread to yarn removal channel 6. Trimming unit 26 becomes inoperative, while transfer trapper 21 moves thread 4*a* to be start-spun to yarn removal channel 6 in such a manner that its end, which is preferably relieved of its spinning twist, is introduced into yarn removal channel 6 and sucked in by the underpressure in spinning rotor 2. In this connection, after transfer trapper 21 opens trapping roller pair 18, 20 and roller 16 provide supplementary advance of a length of thread which can be determined precisely. Transfer trapper 21 places thread 4*a* over a tension feeler 29, which gently reverses the sense of rotation of driven rollers 18 and 16 when a given, predetermined thread tension has been attained after the end of the thread is placed on ring of fibres 3. In this connection, trapping roller pair 18, 20, which can be slowed down or stopped while the tension is measured, ensures that there is no lag in thread delivery, which is significantly more precise than if the thread were only delivered by means of roller 16. Any slip between roller 16 and the winding cone, and the resulting delays, does not affect the start-spinning operation being performed in the spinning rotor, as the thread remains tension-free between rollers 16 and 18, 20 through coordination of the speeds thereof. As it swivels over yarn removal channel 6, transfer trapper 21 pushes the thread stop-motion into its operational position 5 and initiates, in a known manner, feed of the sliver into open-end spinning unit 1. After the start-spinning operation has been completed, transfer trapper 21 and trapping roller pair 18, 20 relieve start-spun thread 4*a* again, which is placed in the operating position shown in FIG. 1 by unillustrated means after roller 16 is lowered.

Figure 4:
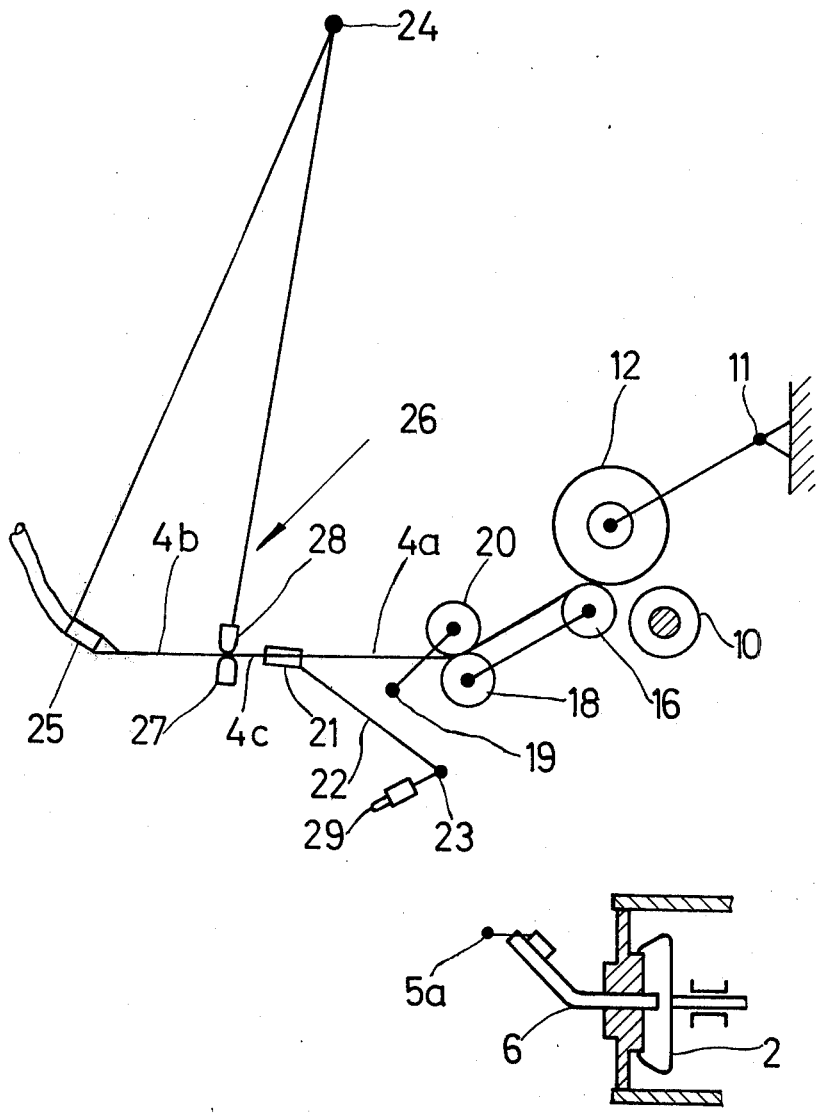

FIG. 6 shows, in a larger scale, the method of operation of transfer trapper 21, operating conjointly with trimming elements 27, 28 as well as suction nozzle 25 (cf. also FIG. 4). Thread 4*a* to be start-spun is held securely between two trapping jaws 32 and 33 of transfer trapper 21 and is trimmed at point 31 in any desired manner. It is practical for this operation to be performed in such a manner that section 4c of the thread is relieved of its spinning twist. To accomplish this, for example, it is possible for rotating or reciprocating trimming elements 27, 28 to separate the thread into its fibres. Section 4*b* of the thread is sucked in by suction nozzle 25. In order to ensure that the end 4*c* of the thread is transferred reliably to yarn removal channel 6, transfer trapper 21 has a two-section hollow-like extension 34, 35, which guides end 4*c* of the thread. Together with trapping jaw 33, the lower half 35 of the extension can be swivelled about axle 36 against the tension of a spring 38 by release means 37, thereby releasing thread 4*a* to be start-spun.

FIG. 7 shows an embodiment in which the two members 34 and 35 of the cylindrical extension surround section 4*c* of the thread.

FIG. 8 shows transfer trapper 21 in the position in which the thread is transferred to yarn removal channel 6. End 4*c* of the thread 4*a* to be start-spun, relieved of its spinning twist, is held by trapping jaws 32*a* and 33*a* and guided in two-section cylindrical extension 34*a* and 35*a*. It is practical for extension 34*a*, 35*a* to have holes 39, through which air is sucked from the spinning unit. This provides additional alignment of end 4*c* of the thread. In order to make full utilization of the underpressure in spinning rotor 2, it is important for extension 34*a*, 35*a* of transfer trapper 21 to approach yarn removal channel 6, which is preferably designed somewhat flexibly, closely enough. For this reason, yarn removal channel 6 has a connecting member 42, which can be slid in the direction of arrow 40 against the pressure of a spring 41. Connecting member 42 has guideways 43, on which extension 34*a*, 35*a* slide into the transfer position, causing connecting member 42 to be pressed somewhat in the direction of arrow 40. This measure compensates for the assembly and fabrication tolerances, which cannot be completely eliminated. It is practical for connecting member 42 to have an elastic filler ring 44 as well as means 45 preventing rotation. In this embodiment, tubular extension 34*a*, 35*a* of transfer trapper 21 is generally aligned with yarn removal channel 6. The suction of the latter acts through openings 39 in transfer trapper 21. When trapping jaws 32*a*, 33*a* are opened, thread 4*a* is released and sucked into yarn removal channel 6 with the aid of trapping roller pair 18, 20.

For this reason, extension 35*a* pushes thread stop-motion 5 into the indicated position, which represents its operating position in terms of function. Normally, this initiates feed of the sliver in a known manner by means of a switch 46. However unillustrated means can also be provided for controlling sliver feed independently of the position of thread stop-motion 5 during the start-spinning operation in order to provide a better starting-sequence characteristic for the sliver feed. Arms 47 and 48 opening in the direction of arrows 49 and 50 cause trapping jaws 32*a*, 33*a* as well as extension 34*a*, 35*a* to open. However FIG. 8 shows an additional possibility for opening trapping jaws 32a, 33a independently of the extension 34a, 35a. This is performed by swivelling a trapping jaw lever 51 about axle 52 disposed on arm 48 via release means 53 as well as a spring 54. In this embodiment, extension 34*a*, 35*a* is not opened until thread 4*a* has already been start-spun.

Figure 9:
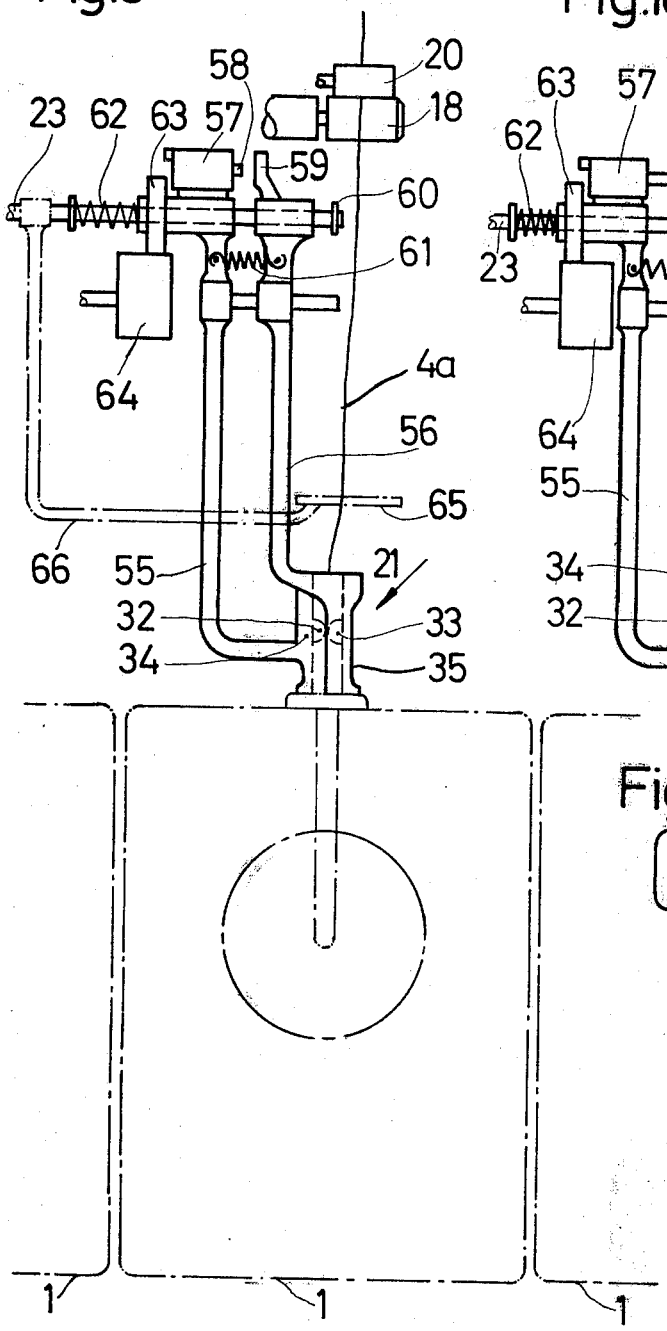
Figure 10:
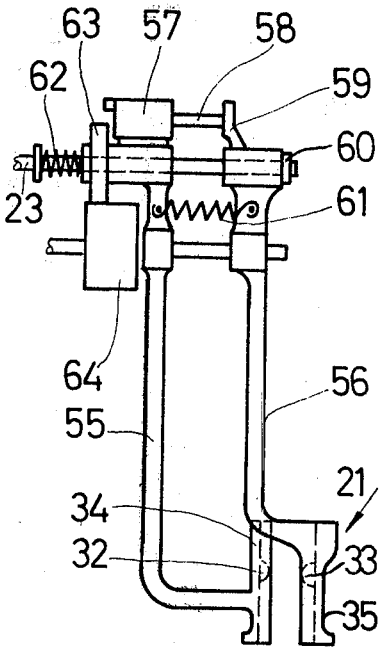
Figure 11:
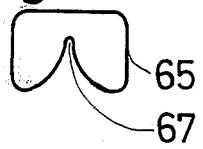

FIGS. 9 and 10 show a preferred embodiment of transfer trapper 21 with respect to opening and closing trapping jaws 32 and 33 and with respect to the design of extension 34 and 35. The contours of three open-end spinning units 1 of the open-end spinning machine are indicated with dash-dotted lines. Transfer trapper 21 opens and closes in the longitudinal direction of the machine, at a right angle to the direction of swivel. This provides the significant advantage that when transfer trapper 21 then swivels about axle 23, travel of start-spun thread 4a is not impaired. Transfer trapper 21, shown in a closed state in FIG. 9 and in an open state in FIG. 10, has two swivel arms 55 and 56, which can be moved away from one another symmetrically to thread 4*a* together with their dish-shaped guides 34 and 35. This is performed by means of control element 57, whose piston 58 pushes lever 59, and thus swivel arm 56, to the right against spring 61 until it comes into a contacting relationship with setting ring 60. When transfer trapper 21 is opened, dish 35 of hollow-like extension 34, 35 thus first moves to the right, away from thread 4*a*, thereby releasing said thread, permitting it to be fed into open-end spinning unit 1 by means of trapping roller pair 18, 20. During the further course of the movement of piston 58 of control element 57, swivel arm 55 is also moved, in this case to the left, in the opposite direction, until piston 58 has been fully extended. This movement is made against spring 62 in that swivel arm 56 is in a supporting relationship against setting ring 60. During this motion, a gear 63, which is fixedly connected with swivel arm 55, is pushed toward the outside and onto a driving gear 64. The two gears 63 and 64 belong to a motor-powered drive system for transfer trapper 21, which is not illustrated in more detail. FIG. 10 shows the open, limit position of both swivel arms 55 and 56, which are now located in a position in which they can be swivelled away about axle 23 without interfering with the travel of thread 4*a*. Together with swivel arms 55 and 56 of transfer trapper 21, it is also possible to swivel support arm 66 of a centering plate 65 (indicated by dash-dotted lines), which guides thread 4*a* laterally through its slot 67 in such a manner that said thread passes through extension 34, 35 centrally when transfer trapper 21 is closed. (cf. also FIG. 11).

Figure 12:
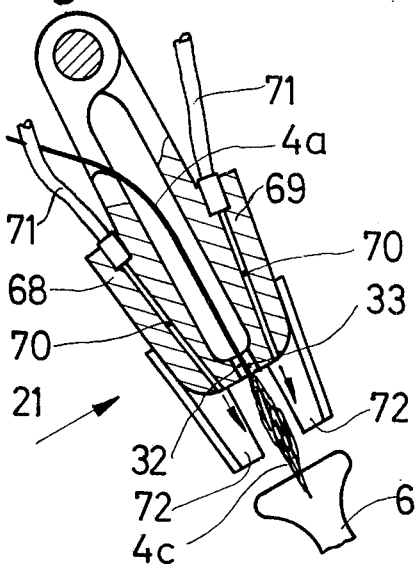
Figure 13:
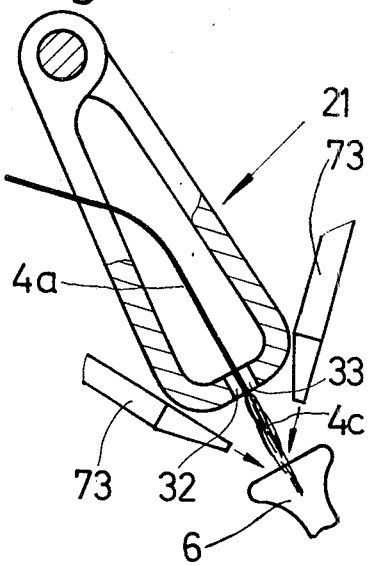

The guides 68 and 69 of trapping jaws 32 and 33 in the transfer trapper 21 shown in FIG. 12 have two nozzle-like holes 70, to which compressed-air lines 71 are attached. With the aid of two baffles 72, a longitudinal flow of air is generated on end 4c of the thread (cf. indicated arrows), whereby the flow of air acts into yarn removal channel 6. The purpose of the flow of air is to offer yarn removal channel 6 an aligned end 4c of the thread. In the embodiment shown in FIG. 13, compressed air nozzles 73 are disposed independently of transfer trapper 21. They only become operational at the last moment in order to insert end 4c of the thread into yarn removal channel 6.

Figure 14:
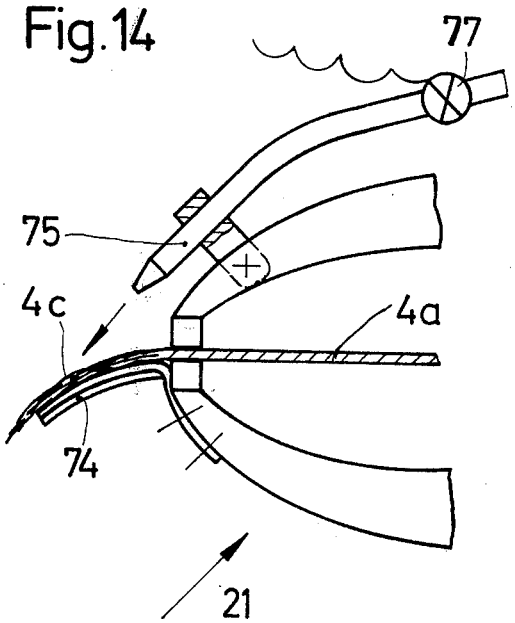
Figure 15:
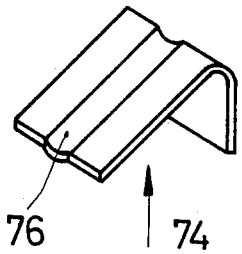

FIGS. 14 and 15 show a transfer trapper 21 which has a support table 74 having a groove 76, into which end 4c of the thread is pressed by the flow of air from compressed air nozzle 75. The flow of air can be dimensioned briefly by means of a control element 77 in such a manner that end 4c of the thread opens, i.e. is freed of its spinning twist. In this case, trimming unit 26 (cf. FIG. 2) would only perform the actual trimming of thread 4a. Opened end 4c of the thread is aligned in such a manner that it can be reliably taken over by yarn removal channel 6.

Figure 16:
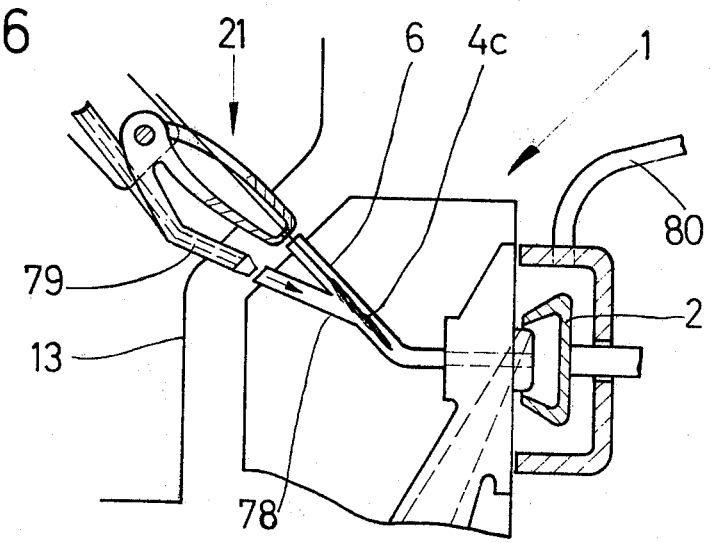

FIG. 16 shows an embodiment in which end 4c of the thread, which is brought to open-end spinning unit 1 by transfer trapper 21 of start-spinning unit 13, is subjected to an air flow in yarn removal channel 6. Yarn removal channel 6 has a branch 78, against whose end a compressed air nozzle 79, which is coupled with transfer trapper 21, is placed. In this case, the air flow serves primarily to open end 4*c* of the thread and assist the introduction of end 4*c* of the thread into yarn removal channel 6 through its ejector effect. In addition, it is also advantageous for subsequent supply of end 4*c* of the thread and opening thereof to be performed in stages.

It is practical for insertion and separation of end 4*c* of the thread to be performed while spinning rotor 2 is still stationary or only just beginning to slowly start. In this case, the fibres separated by the flow of air are not sucked into spinning rotor 2, but into an underpressure channel 80, to which spinning rotors 2 are attached. Alternatively, it is also possible, especially with fibres which are suitable herefor and which are completely separated by the flow of air, to insert said fibres into spinning rotor 2 while it is already rotating as a preliminary feed. Step-by-step separation of end 4*c* of the thread through intermittent feed with briefly opened transfer trapper 21 is, of course, also possible.

Figure 17:
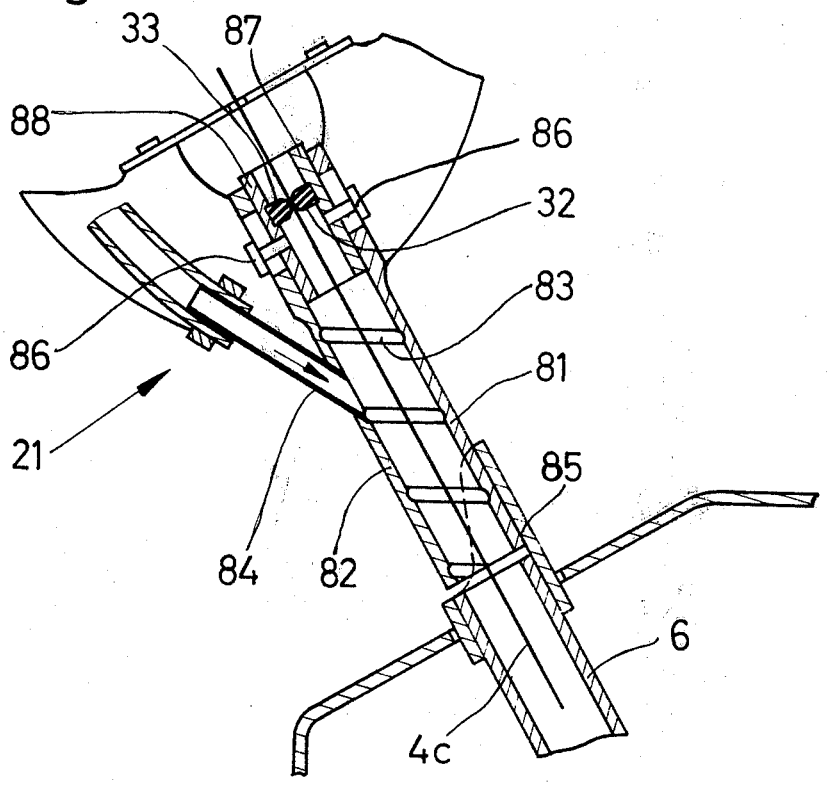

The transfer trapper 21 shown in FIG. 17 has both a hollow-like extension 81, 82 as well as a compressed air nozzle 84, whose flow of air can serve for aligning end 4*c* of the thread on the one hand and for opening said end on the other. The interior of hollow-like extension 81, 82 has spiral-shaped scoring 83, whose pitch is contrary to the spinning twist of end 4*c* of the thread. This interior spiral 83 imparts a corresponding spin to the compressed air, through which end 4*c* of the yarn is caused to open. In this embodiment, inserts 87, 88 for trapping jaws 32, 33 are exchangeable and/or adjustable, by means of adjusting screws 86, in the longitudinal direction of transfer trapper 21. Thus, the trapping point can be matched to the respective technological spinning conditions. In the case of shorter fibres, it must be shifted downward; in the case of longer fibers, end 4*c* is extended upwardly.

The flow of air can thus be employed to keep an opened end 4*c* of the thread straight; or it can also cause end 4*c* of the thread to be opened. It is important for the following conditions to be satisfied for good joining of the thread:

a. The thread must be supplied in such a manner in that it is controlled by a pair of trapping rollers in the respective direction.
b. The end of the thread must also be trapped, with its length being controlled, when it is separated. It is advantageous for the separated end 4c of the thread to correspond generally to the staple length.
c. The end of the thread to be start-spun must always be — reproducibly — of the same length.
d. The end of the thread should be tapered narrower, which is achieved by the flow of air, in particular.

Obviously, many modifications and variations of the present invention are possible in the light of the above teachings. It should therefore be understood that within the scope of the appended claims, the invention may be practiced otherwise than as specifically described.

Having thus fully disclosed my invention, what I claim is:

1. A start-spinning apparatus which travels along an open-end spinning machine having at least one yarn removal channel connected with a respective at least one spinning rotor, comprising means for lifting away a winding cone of an open-end spinning unit, trimming means, a pair of trapping rollers, a movably arranged suction nozzle for picking up an end of thread from said winding cone and placing said end of said thread into the effective area of said trimming means and said pair of trapping rollers, and movably arranged transfer trapping means for trapping said end of said thread in the area of said trapping means and transferring said end of said thread to the yarn removal channel, whereby said pair of trapping rollers controls the return of said end of said thread into said spinning rotor and withdrawal therefrom again.

2. The apparatus according to claim 1, in which said trimming means are combined with separating means which free said end of said thread of its spinning twist.

3. The apparatus according to claim 1, in which a further driven roller is connected with a driven roller of said pair of trapping rollers, said further driven roller being movably mounted in order to lift away said winding cone.

4. The apparatus according to claim 1, in which said trimming means are movably arranged relative to said transfer trapping means.

5. The apparatus according to claim 1, in which said transfer trapping means are mounted pivotally, in the vertical direction, with a swivel lever, on a horizontal axis above said spinning unit.

6. The apparatus according to claim 5, in which said yarn removal channel is disposed at a distance from the axis of said transfer trapping means which approximates the length of said swivel lever.

7. The apparatus according to claim 1, in which a tension feeler, over which said thread is placed, is disposed between said pair of trapping rollers and said yarn removal channel.

8. The apparatus according to claim 1, in which, in the closed state, said transfer trapping means have an extension, extending in the direction of said end of said thread and at least partially surrounding said end of said thread.

9. The apparatus according to claim 8, in which said extension has air inlet openings.

10. The apparatus according to claim 8, in which a pressure member, which yields in the direction of said yarn removal channel, is disposed between said extension and said yarn removal channel.

11. The apparatus according to claim 8, in which means for centering said end of said thread relative to said transfer trapping means are provided in the area of said extension of said transfer trapping means.

12. The apparatus according to claim 8, in which said extension comprises primarily two dish-like members which can be separated one from the other.

13. The apparatus according to claim 12, in which said transfer trapping means can be opened and closed on a plane which is perpendicular to the swivel axis thereof.

14. The apparatus according to claim 8, in which one member of said extension and one trapping jaw of said transfer trapping means are each associated to a common swivel lever, said swivel levers being coupled one with the other and pivotally arranged on a common axis, said swivel levers further having drive means for performing a relative movement.

15. The apparatus according to claim 8, in which said trapping jaws of said transfer trapping means can be opened while said extension is closed.

16. The apparatus according to claim 1, in which said transfer trapping means have means for driving a thread stop-motion disposed in the area of the mouth of said yarn removal channel.

17. The apparatus according to claim 8, in which said transfer trapping means have means for driving a thread stop-motion disposed in the area of the mouth of said yarn removal channel.

18. The apparatus according to claim 1, in which at least one compressed air nozzle is disposed in the area of said yarn removal channel, the outlet direction of said compressed air nozzle being directed at said yarn removal channel.

19. The apparatus according to claim 18, in which at least one compressed air nozzle is arranged at said transfer trapping means.

20. The apparatus according to claim 19, in which at least one compressed air nozzle is arranged on a cylindrical extension of said transfer trapping means.

21. The apparatus according to claim 20, in which at least one compressed air nozzle opens into said extension of said transfer trapping means.

22. The apparatus according to claim 21, in which said extension has spiral-shaped scoring contrary to the direction of twist of said end of said thread.

23. The apparatus according to claim 18, in which the outlet direction of at least one said compressed air nozzle is directed toward a groove in a support table adjacent to said transfer trapping means.

24. The apparatus according to claim 19, in which the outlet direction of at least one said compressed air nozzle is directed toward a groove in a support table adjacent to said transfer trapping means.

25. The apparatus according to claim 18, in which said transfer trapping means have at least one compressed air nozzle connected to said yarn removal channel.

26. The apparatus according to claim 8, in which said trapping jaws are adjustably arranged on said transfer trapping means.

* * * * *